United States Patent [19]

de Gaillard

[11] 4,278,410

[45] Jul. 14, 1981

[54] ROTATABLE PNEUMATIC GEAR MOTOR HAVING A DEFORMABLE ADJUSTABLE SEALED CHAMBER

[75] Inventor: Alain de Gaillard, Paris, France

[73] Assignee: Umicum S.A., St. Etienne Loire, France

[21] Appl. No.: 42,033

[22] Filed: May 24, 1979

[30] Foreign Application Priority Data

May 30, 1978 [FR] France ..... 78 16949

[51] Int. Cl.[3] ..... F01C 5/06; F01C 1/18; F01C 19/00

[52] U.S. Cl. ..... 418/108; 418/156; 418/178; 418/206

[58] Field of Search ..... 418/126–129, 418/153, 156, 205, 206, 108, 178

[56] References Cited

U.S. PATENT DOCUMENTS

| | | | |
|---|---|---|---|
| 763,525 | 6/1904 | Van Beresteyn | 418/127 |
| 2,046,103 | 6/1936 | Austin | 418/206 |
| 2,395,824 | 3/1946 | Herman | 418/178 |
| 2,504,230 | 4/1950 | Smith | 418/108 |
| 2,824,524 | 2/1958 | Banker | 418/108 |
| 2,837,031 | 6/1958 | Ilune | 418/129 |
| 2,966,860 | 1/1961 | Maynard | 418/152 |
| 3,076,413 | 2/1963 | Hoffer | 418/206 |
| 3,852,004 | 12/1974 | Foster et al. | 418/126 |

FOREIGN PATENT DOCUMENTS

| | | | |
|---|---|---|---|
| 614926 | 9/1926 | France . | |
| 873009 | 3/1942 | France . | |
| 880359 | 12/1942 | France . | |
| 1033234 | 6/1955 | France . | |
| 1392 | of 1855 | United Kingdom | 418/153 |
| 108394 | 8/1917 | United Kingdom | 418/127 |
| 696320 | 8/1953 | United Kingdom . | |

*Primary Examiner*—John J. Vrablik
*Attorney, Agent, or Firm*—Haseltine and Lake

[57] ABSTRACT

A pneumatic rotary motor comprising a body to which is secured a bracer bushing closed by a cover. A deformable bushing is freely housed within the bracer bushing and is interposed between the cover and the casing. The bushing has a bore and two opposed longitudinal circular recesses extending from the bore. Two intermeshed rotary gears extend longitudinally in the bushing and are centered in a respective recess, the gears teeth sealably contacting the internal bushing along the circular recesses. The gears have shafts respectively supported for rotation in the cover and the casing and form opposed working chambers on either side of the recesses and in communication with openings provided in the cover for the intake and exhaust of a fluid. Screws, or the like, are mounted in the bracer bushing for abutting against the internal bushing to produce deformation thereof at the recesses for effecting sealed contact with the teeth of the gears. The ends of the gears are sealed in relation to the ends of the deformable bushing and the cover and casing.

10 Claims, 5 Drawing Figures

ROTATABLE PNEUMATIC GEAR MOTOR HAVING A DEFORMABLE ADJUSTABLE SEALED CHAMBER

FIELD OF THE INVENTION

This invention relates to a rotary motor for gaseous fluid to be more particularly used as a compressed air motor.

BACKGROUND

It is well-known to form compressed air motors which include a housing forming a body, sealed by at least a cover sealingly mounted and in which at least two cylindrical gears with parallel axes rotate freely, one of which has a power take-off output shaft for co-operation or non co-operation with a speed reducing device incorporated within said body. A fluid inlet and outlet are provided on the lid or cover on either side of the common axis of said gears, while mobile inserted shoes of semi-circular shape disposed within the housing are provided with O-ring seals for application on the outside periphery of said gears to define the working chamber while preventing any fluid leakage that would be detrimental to the proper operation of the device.

This well-known embodiment of a pneumatic motor has important disadvantages, more particularly:

The faultless machining which is necessary for the curvilinear face of each shoe, which must correspond accurately to the outside diameter of the gear.

The necessary arrangement of an O-ring seal interposed between the gear and the shoe, and also between the ends of the curvilinear portions thereof and the portions of the housing adjacent thereto, in order to ensure a total sealing on the edges.

The necessity of a total sealing of the casing, inclusive of the accommodation of the shoes relative to the cover and to the other fastening means thereof.

The necessary use of a seal the ends of which are folded back against the adjacent sides of the housing with interposition of an elastic wedge.

The use of a flowing seal of plastic, such as tetrafluorethylene, which becomes easily scratched upon contact with the dirt contained in the air.

The necessity of a running in prior to putting the motor in operation.

The impossibility for the user to change the shoes.

The high cost price involved by reason of the machining operations and of the great number of parts.

SUMMARY OF THE INVENTION

It is therefore to eliminate these drawbacks that it has been deemed necessary to develop a pneumatic rotary motor forming the subject matter of the invention.

In accordance with a first feature, the motor of the invention is substantially established with an elastically deformable, preferably cylindrical one piece bushing which forms internally, out of its bore, two recesses which are practically semi-circular and diametrally opposed for the engagement and the interlocking, in part, of the external periphery of the teeth of two rotary gears which are centered by their axes in a casing, on the one hand, and in the thickness of an inserted cover. An external bushing which forms a bracing sleeve is interposed and tightened between the cover and the casing, while having transverse clamping means for the purpose of obtaining in front of the thinner recesses of the bushing the deformation of the latter by retraction for the accurate adjustment of the permanent abutment and without play of said recesses on the teeth in contact with the gears.

In accordance with a further feature, the bore of the deformable bushing, on each side of the gears in meshing engagement, allows for two symmetrical chambers formed without any communication with the external bushing which serves as a mechanical abutment only, said sealed working chambers permitting the intake and the exhaust of the fluid by means of openings formed on the cover.

In accorcance with a further feature, the deformable bushing can be freely inserted and centered between the cover and the casing, while having vertical openings to permit the free passage of screws for assembling and clamping the cover to the casing by means of the bracer bushing so that said deformable bushing can be secured independently; said openings permitting by their play relative to the assembling screws the elastic deformation of the inner bushings in front of the abutment recesses thereof on the teeth of the gears.

In accordance with a further feature, elastic non flowing washers of elastomeric material, such as rubber for instance, are interposed between the farthest face of the bushing, the flanks of the gears and the cover, and on the opposite side between the deformable bushing, the opposite flanks and the casing in order to permit the sealed elastic contact of the members in movement independently from the securing which is effected externally by clamping in front of the external bushing which is mounted with slight clearance relative to the external periphery of the deformable bushing.

In accordance with a further feature, and as an alternative embodiment, the frictional faces of the cover on the flanks of the gears, as well as the frictional face of the casing on the opposed flanks, are not treated superficially for the formation of a composite layer ensuring directly a decrease of the friction coefficient and a good resistance to jamming. This surface treatment can be of the "ZINAL" type in the case of an aluminum material or of the alloys thereof, or of any other type such as "STANAL" in the case of a steel material. In such an embodiment, the flanks of the gears abut directly on the treated faces in the absence of any elastic seals, the clamping stress being determined by the height of the deformable bushing.

In accordance with a further feature, the abutment recesses of the deformable bushing are covered by a non-flexible elastic band such as rubber, glued or secured otherwise, to permit the adjustable elastic contact of the periphery of the gear teeth.

In accordance with a further feature and as an alternative embodiment, the friction and abutment recesses of the deformable bushing are optionally treated superficially for the formation of a composite layer ensuring directly a decrease of the friction coefficient and a good resistance to jamming. This surface treatment can be of the "ZINAL" type in the case of an aluminum material and of the alloys thereof, or of any other type such as "STANAL" in the case of a steel material. In such an embodiment, the peripheral external faces of the gear teeth rest directly on the treated surfaces in the absence of any elastic seals.

In accordance with a further feature, the opposed deformations of the bushing in front of the recesses are positioned by locking screws which are threadedly engaged in the external bushing according to a diameter normal to the common axis of the gears.

BRIEF DESCRIPTION OF THE DRAWINGS

The above and other features will be apparent from the following description with reference to the attached drawings, in which, not limitatively.

DETAILED DESCRIPTION

Figure 5:
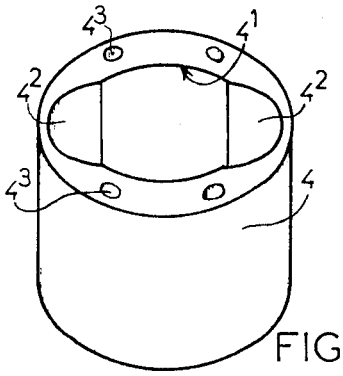
FIG. 5 is a perspective view of the deformable bushing.
Figure 3:
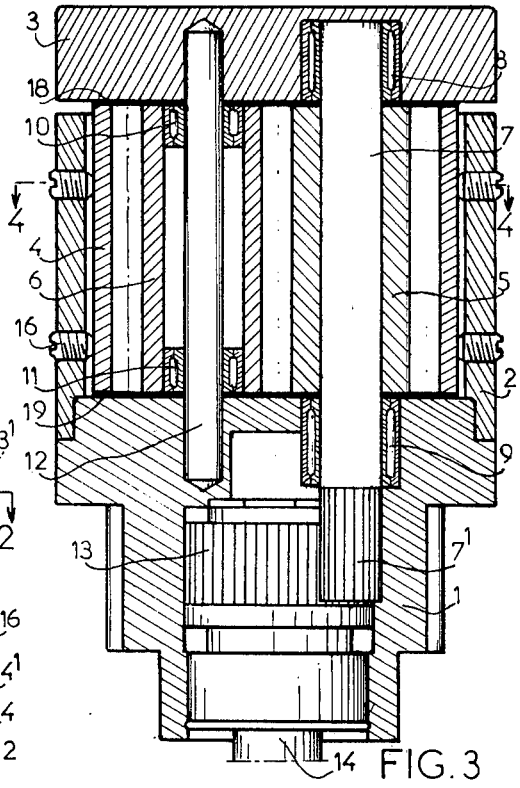
FIG. 3 is a cross section along line 3—3 in FIG. 1.
Figure 1:
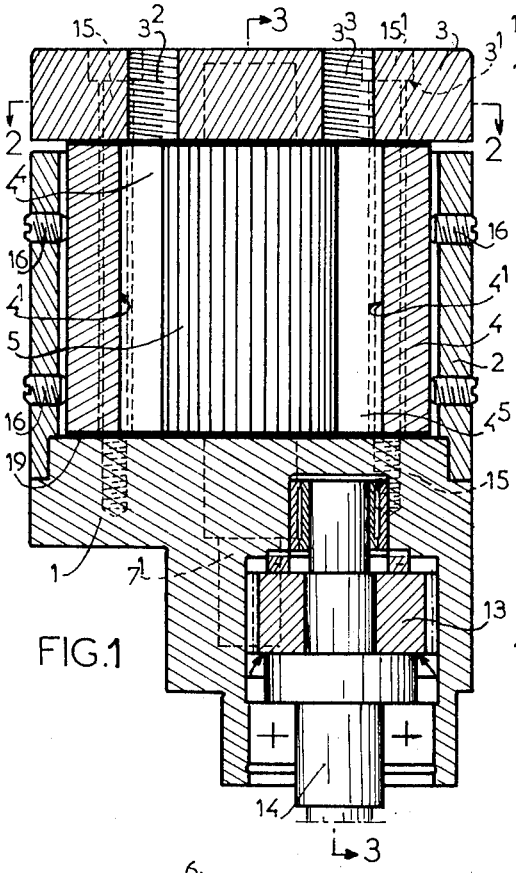
FIG. 1 is a longitudinal sectional view of the pneumatic rotary motor in accordance with the invention.
Figure 4:
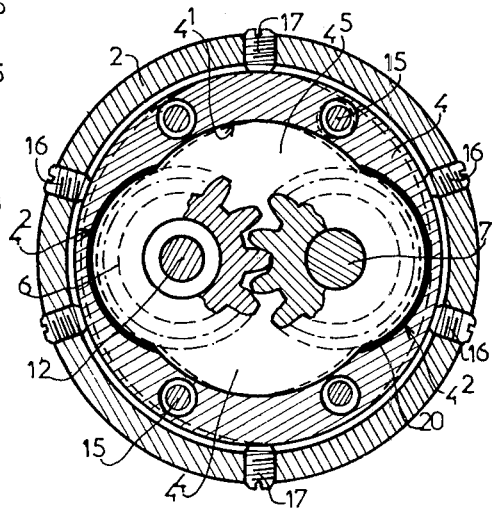
FIG. 4 is a diametral section along line 4—4 of FIG. 3.
Figure 2:
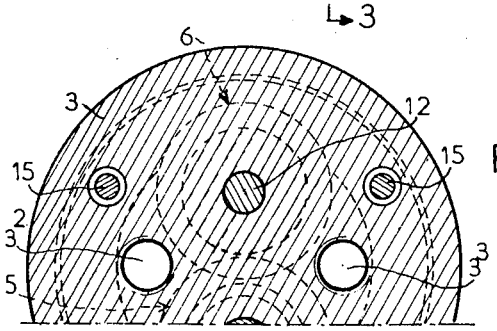
FIG. 2 is a diametral section along line 2—2 in FIG. 1.

According to the present invention, a pneumatic rotary motor includes substantially a body or casing 1 preferably of metal forming a shouldered portion at the end thereof for the engagement of an external cylindrical bushing 2 the opposed end of which is closed by a cover 3.

A deformable internal bushing 4, freely engaged within the external bushing 2, is provided with an axial bore $4^1$ and two opposed indents $4^2$ in the form of circular sectors, which are diametrically opposed and form locally reduced thicknesses of said bushing 4.

Two gears 5 and 6 of the same diameter are disposed vertically in the bore $4^1$ of the bushing 4, along the axis of the indents $4^2$ in order to inter-mesh and to be centered externally along their teeth in said indents $4^2$ while thus defining on each side a circular arc of abutment.

The drive gear 5 is mounted on a rotary spindle 7 which is supported in needle bearings 8 and 9 housed within recesses of cover 3 and casing 1, while the free gear 6, provided with needle bearings 10 and 11 mounted within the axial opening of this gear, runs freely on a fixed spindle 12 the ends of which are engaged in blind holes in said cover 3 and in said casing 1.

It will be noted that the rotary spindle 7 projects from the casing 1 for a direct drive of a member or of a tool, or the spindle co-operates with a speed reducing device housed within said casing 1. For this purpose, the end of spindle 7 has a serration $7^1$ which co-operates with a toothed wheel 13 of larger diameter mounted on an output shaft 14 which freely runs on bearings engaged within a recess of casing 1.

This assembly is maintained in position by clamping screws 15 whose heads $15^1$ rest within spaces $3^1$ of cover 3 and are passed with play through apertures $4^3$ which are drilled axially along the height of the deformable bushing 4 beyond the area formed by the opposed indents $4^2$. These screws 15 are directly and threadedly engaged at the end within the blind holes of casing 1 in order to ensure the axial assembly of casing 1, external bushing 2 and cover 3.

Therefore, the deformable internal bushing 4 is merely interposed between the cover 3 and the casing 1, while the clamping screws 15 are disposed beyond and without any communication with the opening thereof receiving the gears 5 and 6 and constituting, in continuation of the indents $4^2$, the opposed and symmetrical working chambers $4^4$ and $4^5$ which are completely sealed as they are formed by a self-contained unit. These chambers $4^4$ and $4^5$ are in communication with the openings $3^2$ and $3^3$ formed in the thickness of cover 3 for the intake and the exhaust of a fluid such as compressed air.

It is very important to note that in accordance with this embodiment, clamping means such as screws 16 are disposed radially along the thickness of the external bushing 2, externally and symmetrically to the indents $4^2$ of the deformable bushing 4, in order to permit, on either side by elastic deformation, the adjustment of the abutment of said indents $4^2$ relative to the periphery of the teeth of gears 5 and 6, ensuring thereby a frictional sealing which prevents the communication of the chambers $4^4$ and $4^5$ in front of the portions in contact of the teeth on the indents.

This elastic deformation of bushing 4 is made possible by the play formed between the holes $4^3$ and the shanks of screws 15. It will be also noted that other screws 17 which are also engaged within the thickness of the external bushing 2 and at right angles with the diametral axis of the gears 5 and 6 act in abutment on the periphery of the deformable bushing 4 so that the deformation thereof is localized only along two semi-circular sectors which correspond to the positioning of the indents $4^2$.

According to the invention, means for direct or indirect friction through interposed elastic seal are also provided in order to ensure the sealing of the flanks of gears 5 and 6 relative to the bottom of cover 3 and of casing 1, on the one hand, and between the periphery of the teeth of said gears 5 and 6 and the concave indents $4^2$ of the deformable bushing 4 on the other hand.

For this purpose, in the case of direct metal to metal friction, there is optionally provided a surface treatment, by coating or otherwise, of the surfaces in contact of cover 3, casing 1, and indents $4^2$. This well-known treatment results in the formation of a composite layer formed by galvanic deposit and metal diffusion associated with a heat treatment or a metal spray, in order to provide good resistance to jamming and wear as well as a decrease of the friction coefficient. As an example, which is in no way a limiting one, and in the case of aluminum material and of the alloys thereof, this treatment is of the "ZINAL" type, or of the "STANAL" type in the case of steel material. Obviously, for a faultless sealing, the gears 5 and 6 of metal or other material will have to be thoroughly machined and polished.

The seals are therefore eliminated by this surface treatment, with the possibility of storing the motor after the running-in thereof, this motor being capable of operating faultlessly as soon as it is started.

In the case of indirect friction, elastic seals 18 and 19 are interposed between the bottom of cover 3, the flanks of gears 5 and 6 and the end of the deformable bushing 4 on the one hand, and on the opposed side opposite the abutment face of casing 1, on the other hand. These seals 18 and 19 can be compressed and adjusted by tightening the member connecting screws 15.

The seals secured on cover 3 and casing 1 by molding, glueing or otherwise, or possibly not secured, are made of non-flowing flexible material, such as rubber or any polymeric material having elastic properties which eliminate the necessity of running-in and the chance of jamming owing to the possibility of deformation of said flexible material.

In the same way, curvilinear seals 20 also of non-flowing elastic material are secured by glueing or otherwise on the indents $4^2$ of the deformable bushing 4 to permit the flexible and sealing contact of the periphery of the teeth of gears 5 and 6. These seals 18, 19 and 20 of non-flowing elastic material have the advantage of eliminating the running-in process, possible jamming, while damping vibrations.

The invention is not limited in any way to the use nor to the embodiments which have been particularly described, and any alternative embodiment remains within the scope of the invention if defined by the appended claims.

I claim:

1. A pneumatic rotary gear motor comprising a body or casing, a bracer bushing secured to said casing, a cover closing said bracer bushing, a deformable internal bushing freely housed within the bracer bushing and interposed between the cover and the casing, said internal bushing having a bore and two opposed longitudinal circular recesses extending from said bore, two intermeshed rotary gears extending longitudinally in said internal bushing and centered in a respective recess, said gears having teeth sealably contacting the internal bushing along said circular recesses, said gears having shafts respectively supported for rotation in said cover and casing to form opposed working chambers in said internal bushing disposed on either side of the recesses and in communication with openings provided in the cover for the intake and exhaust of a fluid; adjusting means integral with the bracer bushing for abutting against the internal bushing to produce deformation thereof at the recesses for effecting sealed contact with said teeth; fixed abutment means, said abutment means being adapted to cooperate with said freely housed internal bushing through said bracer bushing for limiting the deformation of the internal bushing; an assembling means for the cover, bracer bushing, and casing including screws which are passed freely through holes provided in the internal bushing so that the deformation thereof will not be interfered with; and frictional means interposed between the ends of the gears, the ends of the deformable bushing and the cover and casing on the one hand, and between the circular recesses of said internal bushing in contact with the teeth of said gears on the other hand.

2. A pneumatic rotary motor as claimed in claim 1, wherein said opposed working chambers are disposed at right angles on each side of a plane passing through the rotational axes of said gears.

3. A pneumatic rotary motor as claimed in claim 2 wherein said screws abut against the cover and pass through holes provided in the casing, said screws being engaged with play in the holes of said internal bushing so that the deformation of the internal bushing in front of the recesses will not be interfered with.

4. A pneumatic rotary motor as claimed in claim 3 wherein said adjusting means comprises adjusting screws in said bracer bushing, externally and radially for acting on the internal bushing at said recesses to effect by diametral retraction the deformation of said internal bushing for abutment without play on the periphery of the teeth of the rotary gears.

5. A pneumatic rotary motor as claimed in claim 4 wherein said fixed abutment means comprises stop screws threadedly engaged within said bracer bushing for abutment with the external periphery of the deformable bushing.

6. A pneumatic rotary motor as claimed in claim 5 wherein the ends of the gears are sealed relative to the abutting faces of the cover and the casing by direct metal to metal friction.

7. A pneumatic rotary motor as claimed in claim 6 wherein the periphery of the teeth of the gears is sealed relative to the recesses of the deformable bushing by direct metal to metal friction.

8. A pneumatic rotary motor as claimed in claim 1 wherein the ends of the gears are sealed relative to the abutting faces of the cover and of the casing by friction and by the interposition of elastic seals, said seals being adjustable in compression with the cover is secured on the casing.

9. A pneumatic rotary motor as claimed in claim 8 comprising curvilinear seals sealing the periphery of the gear teeth relative to the recesses of the deformable bushing, and being fixed on said internal bushing at said recesses and acting on said teeth.

10. A pneumatic rotary motor as claimed in claim 9 wherein one of said gears is a driving gear integral with a rotational spindle, bearings housed within the cover and the casing for rotatably supporting said spindle, the other gear being a free gear with internally secured bearings, a fixed spindle on which said bearings of the other gear are rotatable, said fixed spindle having ends fitted within recesses in said cover and casing.

* * * * *